US006116970A

United States Patent [19]

Yamamoto et al.

[11] Patent Number: 6,116,970

[45] Date of Patent: Sep. 12, 2000

[54] SETTLING PREVENTING STRUCTURE OF TERMINAL

[75] Inventors: Hiroshi Yamamoto; Tamio Watanabe, both of Shizuoka, Japan

[73] Assignee: Yazaki Corporation, Tokyo, Japan

[21] Appl. No.: 09/262,016

[22] Filed: Mar. 4, 1999

[30] Foreign Application Priority Data

Mar. 6, 1998 [JP] Japan ..... 10-055516

[51] Int. Cl.[7] ..... H01R 11/22

[52] U.S. Cl. ..... 439/852; 439/862

[58] Field of Search ..... 439/850, 851, 439/852, 853, 862

[56] References Cited

U.S. PATENT DOCUMENTS

| | | | |
|---|---|---|---|
| 5,035,658 | 7/1991 | Berg | 439/748 |
| 5,441,428 | 8/1995 | Hamai et al. | 439/843 |
| 5,480,320 | 1/1996 | Saimoto | 439/852 |
| 5,575,696 | 11/1996 | Endo et al. | 439/852 |
| 5,707,259 | 1/1998 | Ishizuka et al. | 439/852 |
| 5,733,155 | 3/1998 | Sagawa | 439/852 |
| 5,791,945 | 8/1998 | Myer et al. | 439/852 |
| 5,951,339 | 9/1999 | Chaillot et al. | 439/852 |
| 5,980,336 | 11/1999 | Hall et al. | 439/843 |

FOREIGN PATENT DOCUMENTS

| | | |
|---|---|---|
| 3-77382 | 8/1991 | Japan . |
| 7-42005 | 7/1995 | Japan . |
| 9-35796 | 2/1997 | Japan . |

*Primary Examiner*—Khiem Nguyen
*Assistant Examiner*—Son V. Nguyen
*Attorney, Agent, or Firm*—Armstrong, Westerman, Hattori, McLeland & Naughton

[57] ABSTRACT

A supporting plate 4 is uprighted from a bottom wall 5 of an electric contact portion 2 of a female terminal 1. Both ends 4*a* of the supporting plate protrude horizontally over a height equal to the height of the supporting plate and are engaged in engagement grooves formed on inner side walls 6 of the electric contact portion 2. The entire width of the supporting plate is larger than the inner width of said bottom wall. Such a settling structure for the terminal surely prevents excess warping of the electric contact potion of the terminal.

8 Claims, 10 Drawing Sheets

SETTLING PREVENTING STRUCTURE OF TERMINAL

BACKGROUND OF THE INVENTION

1. Field of the Invention

The present invention relates to a settling (permanent set in fatigue)preventing structure with a supporting plate arranged on a warping side of an elastic contact portion to prevent excess warping of the elastic contact portion of a female terminal.

2. Description of the Related Art

FIGS. 14–15 show a conventional settling preventing structure of a terminal disclosed in J-UM (Laid-Open)-7-42005.

As seen from FIG. 14, within a square cylindrical electric contact portion 57 of a female terminal 56, a supporting plate 60 is uprighted vertically from a bottom wall 59 on the lower side of an elastic contact piece 58 so that the tip of the supporting plate 60 is opposite to the lower surface of the elastic contact piece 58. When the elastic contact piece 58 is warped, the lower face of the elastic contact piece 58 is brought into contact with the tip of the supporting plate 60, thereby preventing excess warping of the elastic contact piece 58 and its settling.

Further, on both sides of the supporting plate 60, protrusions 61 are formed. On the side walls 62 of the electric contact portion 57, engagement holes 63 are formed so as to correspond to the protrusions 61. Since the protrusions 61 are engaged in the engagement hole 63, fall of the supporting plate 60 can be prevented. As shown in FIG. 15, even when a male terminal is inserted in the electric contact portion 57 so that it pries the elastic contact portion 58, the supporting plate 60 supports the elastic contact piece 58 to prevent its excess warping.

However, the above conventional structure has the following defect. Specifically, when the terminal 56 is miniaturized, the protrusions 61 of the supporting plate 60 have also a very small size so that the engagement force thereof is reduced greatly. Because of the excess weighting, the supporting plate 60 falls as indicated in arrow x. As a result, the elastic contact piece 58 warps excessively and may be settled permanently.

FIGS. 16–17 show another settling preventing structure for a terminal disclosed in J-UM(Laid-Open)-3-77382.

As seen from FIG. 16, within the electric contact portion 66 of a female terminal 65, a pair of supporting pieces 69 are horizontally cut out from both side walls 68 so that the upper end of each supporting piece 69 is opposite to the lower face of the elastic contact piece 67. When the elastic contact piece warps, the lower surface of the elastic contact piece 67 is brought into contact with the upper end of each supporting piece, thereby preventing excess warping of the elastic contact piece 67.

However, this structure has the following defect. As the terminal 65 is miniaturized, the side walls 68 and supporting plates 69 each has a reduced thickness to decrease the rigidity of the supporting plates. Therefore, as shown in FIG. 17, when the elastic contact piece 67 is pried excessively as a result that a prove pin 70 for checking conduction and a jig bar for releasing terminal engagement is inserted, a supporting piece 69 is deformed rearward or downward as indicated by arrow y and hence the elastic contact piece 67 is likely to be settled.

FIGS. 18–19 shows a settling preventing structure of a terminal disclosed in JP-A-9-35796.

As seen from FIG. 18, within an electric contact portion 72 of a female terminal 71, a front and a rear supporting plate 75 are uprighted vertically from a bottom wall 74 on the lower side of an elastic contact piece 73 so that the tip of each supporting plate 75 is opposite to the lower surface of the elastic contact piece 73. When the elastic contact piece 73 is warped, the lower face of the elastic contact piece 73 is brought into contact with the tip of the supporting plate 75, thereby preventing excess warping of the elastic contact piece 73 and its settling.

However, in this structure, as shown in FIG. 19, when the elastic contact piece 73 is subjected to excess load in a prying direction by a probe pin 76 or jig rod, the supporting plates 75 fall as indicated by arrow z and are deformed so that the elastic contact piece 73 is likely to be settled.

SUMMARY OF THE INVENTION

An object of the present invention is to provide a settling preventing structure of a terminal which can prevent the settling due to excess warping of the elastic contact piece.

In order to attain the above object, in accordance with a first aspect of the present invention, there is provided a settling preventing structure for a terminal including an electric contact portion and an elastic contact portion, comprising: a supporting plate uprighted from a bottom wall of the electric contact portion and located on a warping side of the elastic contact portion, wherein the supporting plate is provided with both ends protruding horizontally in a height equal to that of itself, and both the ends are engaged in engagement grooves formed on inner side walls of the electric contact portion.

In accordance with another aspect of the present invention, there is provided a settling preventing structure for a terminal including an electric contact portion and an elastic contact portion, comprising: a supporting piece cut out from an inner wall of the electric contact portion and located on a warping side of the elastic contact portion, wherein the supporting piece includes a stem wall bent from the inner wall and a tip wall bent integrally therefrom, and the stem wall and the tip wall are in contact with a bottom wall of the electric contact portion.

In accordance with still another aspect of the present invention, there is provided a settling preventing structure for a terminal including an electric contact portion and an elastic contact portion, comprising: a supporting plate uprighted from a bottom wall of the electric contact portion and located on a warping side of the elastic contact portion, wherein the supporting plate is provided with reinforcement walls bent from its main body on both sides thereof, and the reinforcement walls are in contact with the bottom wall of the electric contact portion.

In the structures according these aspects, even when the elastic contact piece of the female terminal is strongly pried by a male terminal, a probe pin or jig rod inserted in the electric contact portion of the female terminal, the support plate surely supports the elastic contact piece, thereby preventing the settling due to excess warping of the elastic contact piece.

The above and other object and features of the present invention will be more apparent from the following description taken in conjunction with the accompanying drawings.

Figure 1:
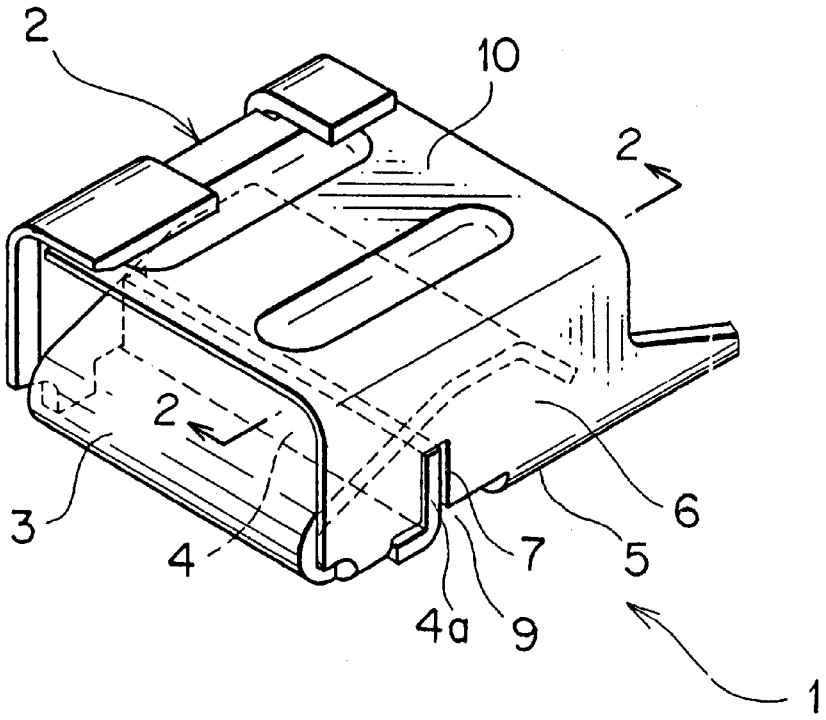
FIG. 1 is a perspective view showing a first embodiment of a settling preventing structure according to the present invention.

The above and other objects and features of the present invention will be more apparent from the following description taken in conjunction with the accompanying drawings.

DESCRIPTION OF THE PREFERRED EMBODIMENTS

Now referring to the drawings, a detailed explanation will be given of embodiments of the present invention.

Embodiment 1

FIGS. 1–5 show a first embodiment of a settling preventing structure of a terminal according to the present invention.

As seen from FIG. 1, within a square cylindrical electric contact portion 2 of a female terminal 1, a supporting plate 4, which has a greater width than that of the internal width of the electric contact portion 2 in a direction perpendicular to its longitudinal direction, is uprighted vertically from a bottom wall 5 on the lower side (warping side) of an elastic contact piece 3. Ends 4*a* of the supporting plate 4 are formed so as to extend vertically straight. Slit-like engagement holes 7 extending vertically, in which the supporting plate 4 is to be engaged, are formed on both side walls 6 of the electric contact portion 2.

As seen from FIG. 1, both ends (end surfaces) 4*a* of the supporting plate 4 protrude so as to be substantially flush with the outer surface of the side wall 6 of the electric contact portion 2. The ends 4*a* of the supporting plate 4 are engaged with the engagement holes 7 over their entire heights. In this configuration, the ends 4*a* of the supporting plate 4 are in contact with the side walls of the electric contact portion 2 over a larger area, thus giving great securing force.

Figure 2:
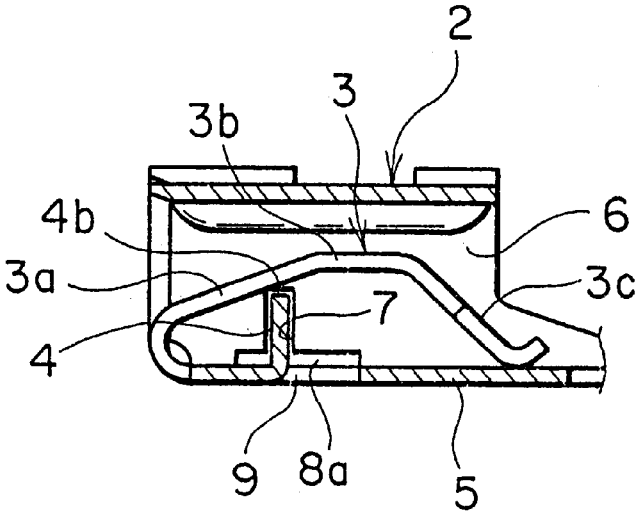
FIG. 2 is a sectional view taken in line 2—2 in FIG. 1.

As seen from FIG. 2, the supporting plate 4 is located on the front side of the electric contact portion 2 and extends from the bottom wall 5 to reach the height which is half as high as the height of the electric contact portion 2. The front slanted portion 3*a* of the elastic contact piece 3 is located oppositely to the supporting plate 4 to provide a gap at the tip 4*b* of the supporting plate 4. The front slanted portion 3*a* is folded integrally from the front end of the bottom wall 5. The front slanted portion 3*a* leads to an intermediate flat top 3*b* which in turn leads to a rear slanted portion 3*c*.

The engagement hole 7 leads to a horizontal slit recess hole 8*a* on the lower end side of the side wall 6. The recess slit hole 8*a* is created when the end 4*a* of the supporting plate 4 is formed (see FIG. 5). The recess hole 8*a* leads to a stamped hole 9 of the supporting plate 4 on the bottom wall 5.

Figure 3:
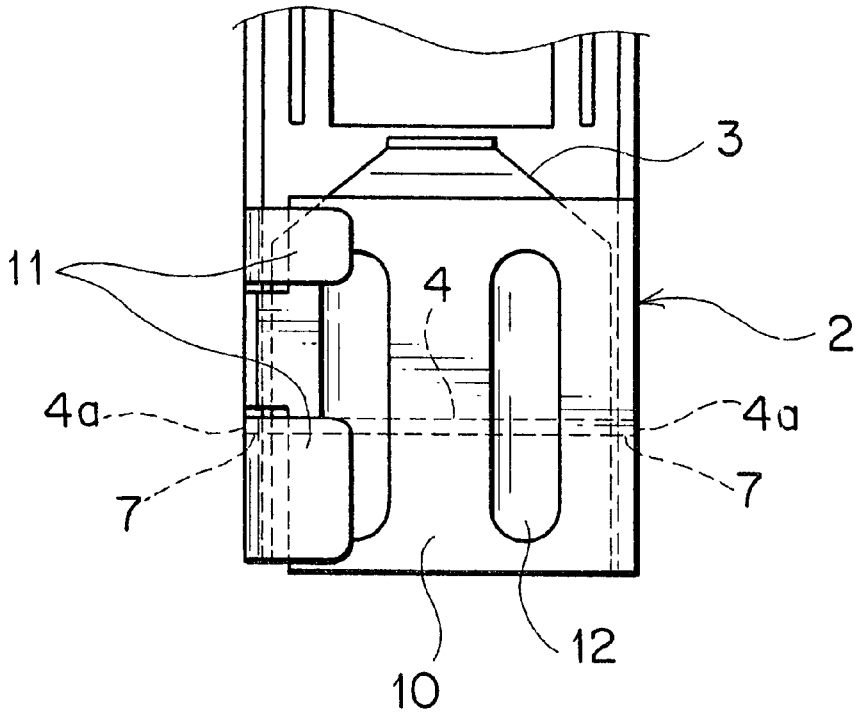
FIG. 3 is a plan view showing the first embodiment.
Figure 4:
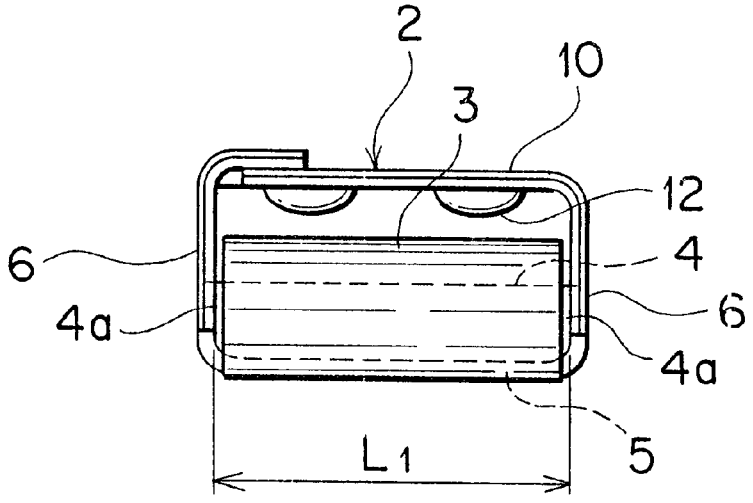
FIG. 4 is a front view showing the first embodiment.

As seen from FIGS. 3 and 4, a ceiling wall 10 of the electric contact portion 2 is pressed and secured by a caulking piece 11 extended from the one side wall 6. On the inner face of the ceiling wall, contact protrusions 12 in the longitudinal direction are formed oppositely to the elastic contact piece 3. Both ends 4*a* of the supporting plate 4 are orthogonal to the side walls 6 and engaged in the engagement holes 7, respectively.

Figure 5:
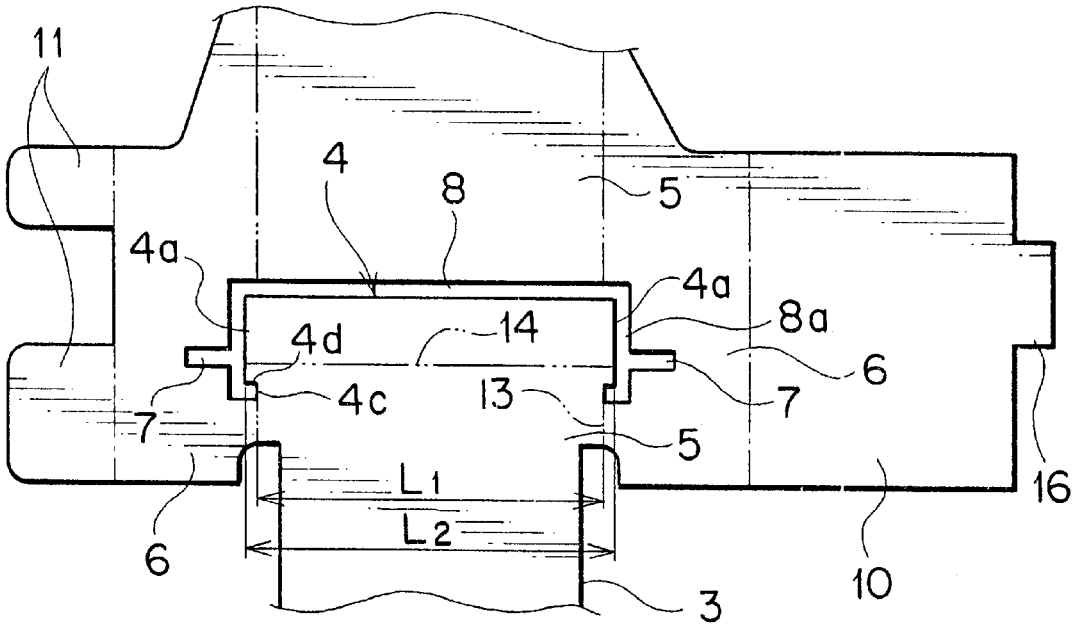
FIG. 5 is an expanded view showing the first embodiment.

FIG. 5 is an expanded view of FIG. 3. As seen from FIG. 5, the supporting plate 4 is stamped from the bottom wall to the side walls 6 in a direction orthogonal to the longitudinal direction of the terminal. Both ends 4*a* of the supporting plate 4 are formed to protrude from the boundary (folding line ) between the bottom wall 5 and side walls 6 toward the side of the side walls 6. The entire width L2 of the supporting plate 4 is set so as to be larger than the width L1 of the bottom wall 5. Both ends 4*a* of the supporting plate 4 is formed straight in a longitudinal direction of the terminal.

The folding line 14 of the supporting plate 4 is located slightly nearer to the tip of the supporting plate than to the uprighting stem 4*c* of the supporting plate 4. The uprighting stem of the supporting plate 4 leads to the bottom wall 5 through a step 4*d*. A ⊐-shaped slit hole 8 is located around the folded supporting plate 4. The slit hole 8 leads to a pair of engagement holes 7 on the side walls on both sides through the recess holes 8*a* which are orthogonal to the slits 8. As described above, the ends 4*a* of the supporting plate 4 are engaged in the engagement holes 7. Forward of the bottom wall 5 successive to the supporting plate 4, the elastic contact piece 3 is extended. The ceiling wall 10 is successive to the one side wall 6. A protrusive piece 16 is formed at the tip of the ceiling wall 10. The caulking pieces 11 located front and rear of the protrusive piece 16 are successive to the other side wall. The electric contact portion 2 is composed of the bottom wall 5, both side walls 6, ceiling wall 10 and elastic contact piece 3. A wire crimping portion (not shown) is formed rearward of the bottom wall 5. The structure shown in FIG. 5 is efficient for a method for manufacturing a female terminal.

In accordance with this embodiment, both ends 4*a* of the supporting plate 4 each has a longer contact portion over the entire height from the top to the bottom and the slit-lie engagement holes 7 each has also a longer contact portion. As a result, both ends 4*a* of the supporting plate 4 are supported by the engagement holes 7 over their larger contact area to give great securing force. Therefore, even when great prying force is given to the elastic contact piece 3, the supporting plate will not fall nor be deformed. Further, even when the terminal 1 is miniaturized and the thickness of the supporting plate is reduced, because of the above configuration, the supporting plate 4 will not fall, thereby preventing its settling from occurring.

In addition, since the slit-like engagement hole 7 is formed integrally to the stamping hole 9, the stamping of the engagement hole 7 can be effected simultaneously with forming the supporting plate 4 thereby making it possible to fabricate the terminal 1 easily. The accuracy of positioning the engagement holes 7 for the supporting plate 4 can be also improved so that the elastic contact piece 3 can be secured by the supporting plate 4.

Embodiment 2

FIGS. 6–9 show a second embodiment of a settling preventing structure of a terminal according to the present invention.

Figure 6:
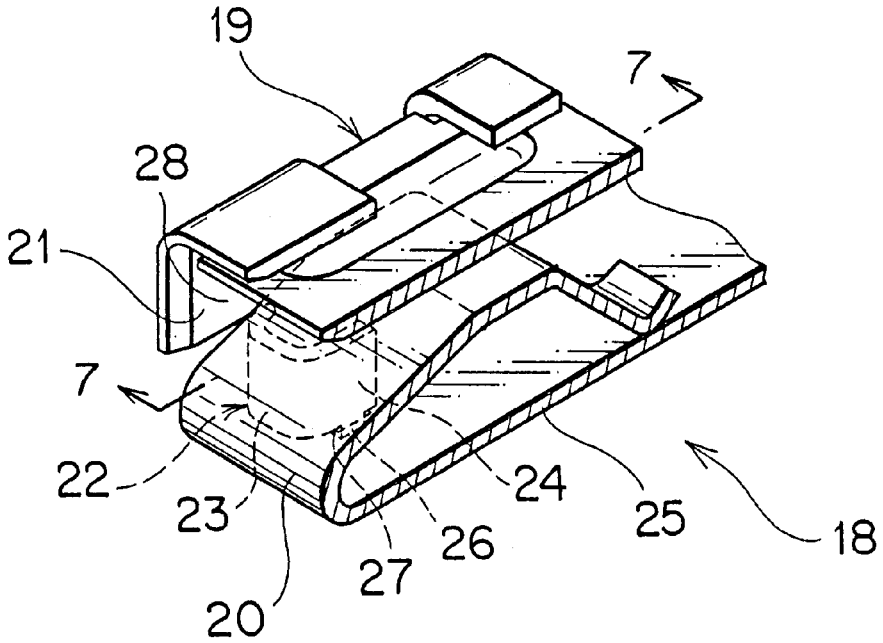
FIG. 6 is a perspective view showing a second embodiment of a settling preventing structure according to the present invention.

As seen from FIG. 6, within a square cylindrical electric contact portion 19 of a female terminal 18, a pair of supporting pieces 22 are cut up horizontally from the side walls 21 on both sides on the lower side (warping side) of an elastic contact piece (elastic contact portion) 20 so that the lower end faces 22*a* of each of the supporting pieces 22 are in contact with the upper face 25*a* of a bottom wall 25, the stem wall 23 of the supporting piece 22 is positioned orthogonally to the side walls 21, the tip of the supporting piece 22 is bent in a longitudinal direction of a terminal to form a tip wall 24, a securing protrusion 26 is dangled at the lower end of the tip wall 24 of the tips and engagement holes 27 for the securing protrusions 26 is formed in the bottom wall 25.

Figure 7:
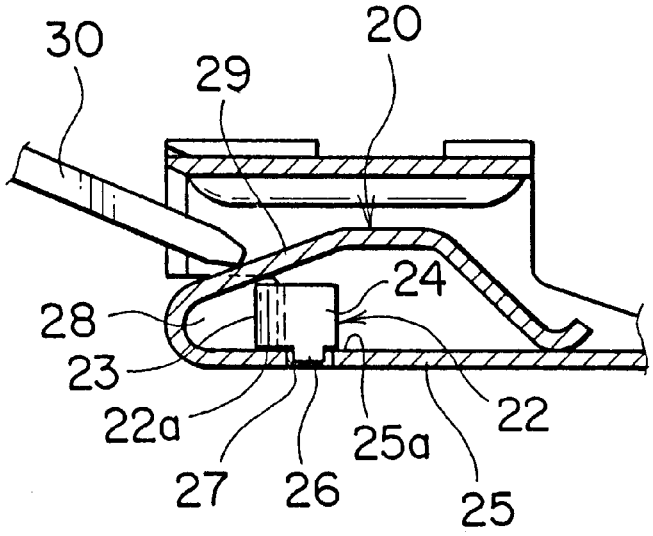
FIG. 7 is a sectional view taken in line 7—7 in FIG. 6.

As seen from FIGS. 6 and 7, the supporting pieces 22 are cut from the front ends of the side walls 21 so that square recess holes 28 remain. The stem wall 23 of each of the supporting pieces 22 has a length approximately equal to the wall 24 of the tip. The stem wall 23 and tip wall 24 may cross the side wall 21 at a right angle or a curved manner as shown in FIG. 8.

As shown in FIG. 7, the stem wall 23 is opposed to the front slanted portion 29 of the elastic contact piece 20 to provide a space or gap at the intermediate position of the front slanted portion 29. The tip wall 24 extends to below the end of the front slanted portion 29. The securing protrusion 26 is formed at the lower end of the wall at the tip. The protruding length of the securing protrusion 26 is slightly smaller than the depth of the engagement hole 27 or thickness of the bottom wall 25.

When the elastic contact piece 20 is strongly pushed by a male terminal 30 for connection, a probe pin for conduction or jig for releasing securing, the front slanted portion 29 is brought into contact with the stem wall 23. If the pushing force is great, the front slanted portion 29 further warps so that it is also brought into contact with the tip wall 24. In this case, even if the rearward falling force acts on the stem wall 23, the tip wall 24, which is perpendicular to the wall 23 tightly supports the stem wall 23, and the securing protrusion 26 secures the tip wall 24 to the bottom wall 25. For this reason, the stem wall 23 does not fall not become deformed.

Figure 8:
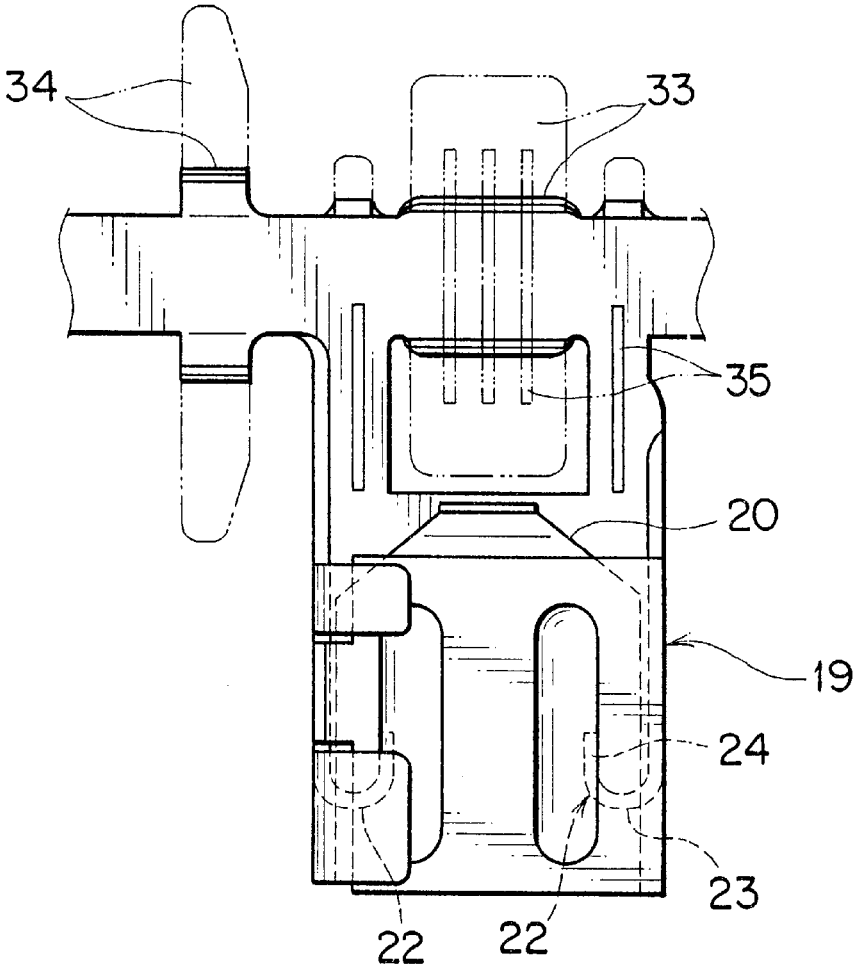
FIG. 8 is a plan view showing the second embodiment.
Figure 9:
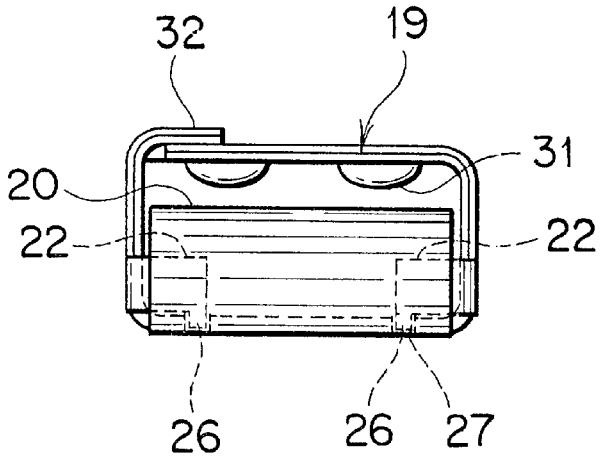
FIG. 9 is a front view showing the second embodiment.

As seen from FIGS. 8 and 9, the pair of supporting plates 22 are provided so as to be opposed to each other. The elastic contact piece 20 may be divided into two pieces so as to correspond to the supporting pieces 22. In FIGS. 8 and 9, reference numeral 31 denotes a protrusive strip for contact; 32 a caulking piece; 33 a wire conductor crimping piece; 34 a wire covering crimping piece; and 35 a hib. Incidentally, in this embodiment, the electric wire is connected to the terminal 18 in a direction perpendicular to the electric contact portion 19.

Additionally, the pair of supporting pieces may not be provided. Otherwise, a single long stem wall 23 extending from the one side wall 21 or an extended side wall (not shown) may be provided.

In accordance with this embodiment, the supporting pieces 22 are formed in an L-shape bent from the side walls; the stem wall 23 of the supporting plate 22 is integrally secured to the side wall 21; the tip wall 24 of the supporting plate 22 is bent at the right angle and its securing protrusion 26 is secured to the engagement hole 27 of the bottom wall 25. Therefore, the supporting plate 22 has high rigidity, and the fall or deformation of the supporting piece 22 does not occur. Even if the terminal 18 is miniaturized and the thickness of the supporting plate 22 is reduced, the supporting plate will not settled nor deformed against strong pushing force so that the elastic contact piece 20 can be firmly supported by the supporting plate.

Embodiment 3

FIGS. 10–13 show a third embodiment of a settling preventing structure of a terminal.

Figure 10:
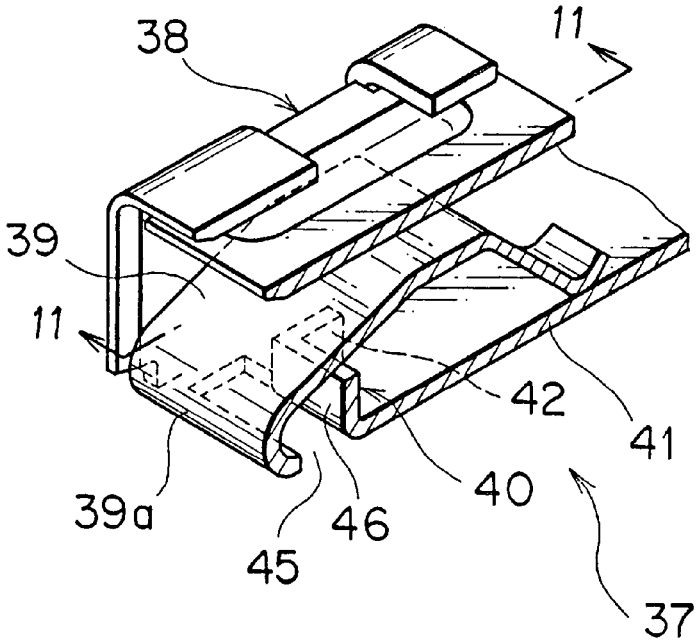
FIG. 10 is a perspective view showing a third embodiment of a settling preventing structure according to the present invention.

As seen from FIG. 10, within a square cylindrical electric contact portion 38 of a female terminal 37, a supporting plate 40 in a width direction of the terminal is uprighted vertically from a bottom wall 41 on the lower side (warping side) of an elastic contact piece 39 so that both ends 42 of the supporting plate 40 are bent at the right angle in a longitudinal direction of the terminal to form walls and supported on the bottom wall 41, the walls 42 are each provided with a securing protrusion, and an engagement hole 43 corresponding to the securing protrusion 43 is formed in the bottom wall 41.

Figure 11:
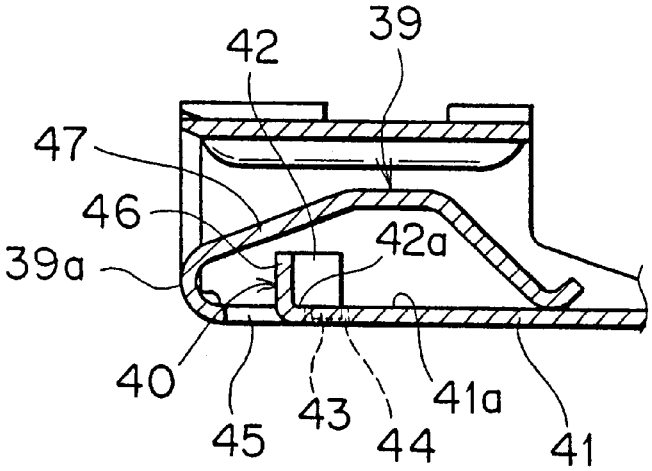
FIG. 11 is a sectional view taken in line 10—10 in FIG. 10.

As seen from FIGS. 10 and 11, between the supporting plate 40 and the front end 39*a* of the elastic contact piece 39, a stamped through-hole 45 is located in the bottom wall 41. The stamped through-hole 45 is created by cutting up the supporting plate 40 from the bottom wall 41. The walls 42 on both sides (side walls) of the supporting plate 40 are cut off from the bottom wall 41, and bent rearward at the right angle from the wall 46 on the front (main wall) of the supporting plate 40. The lower face 42*a* of the side wall 42 is in contact with the upper face 41*a* of the bottom wall 41, thus preventing the main wall 46 from falling. The side wall 42 is provided with a securing protrusion 43 dangling from its lower face 42*a*. The length of the securing protrusion 43 is substantially equal to or slightly smaller than the depth of the engagement through-hole 44, i.e. thickness of the bottom wall 41. The securing protrusion 43 can be easily engaged in the engagement through-hole 44 in such a manner that the side wall 42 is bent at the right angle from the main wall 46 and the main wall 46 is bent vertically. Namely, simultaneously when the main wall 46 is bent, the securing protrusion 43 can be smoothly inserted into the engagement hole 44 while it draws an arc.

The main wall 46 of the supporting plate 40 is opposed to the front slanted portion 47 of the elastic contact piece 39 to provide a gap at the intermediate position of the front slanted portion 47. The side wall 42 extends to below the end of the front slanted portion 47. Preferably, the horizontal length of the securing protrusion 43 is close to the side wall 42 and the engagement hole 44 has a size enough to engage with the securing protrusion 43 with no rattle.

Figure 12:
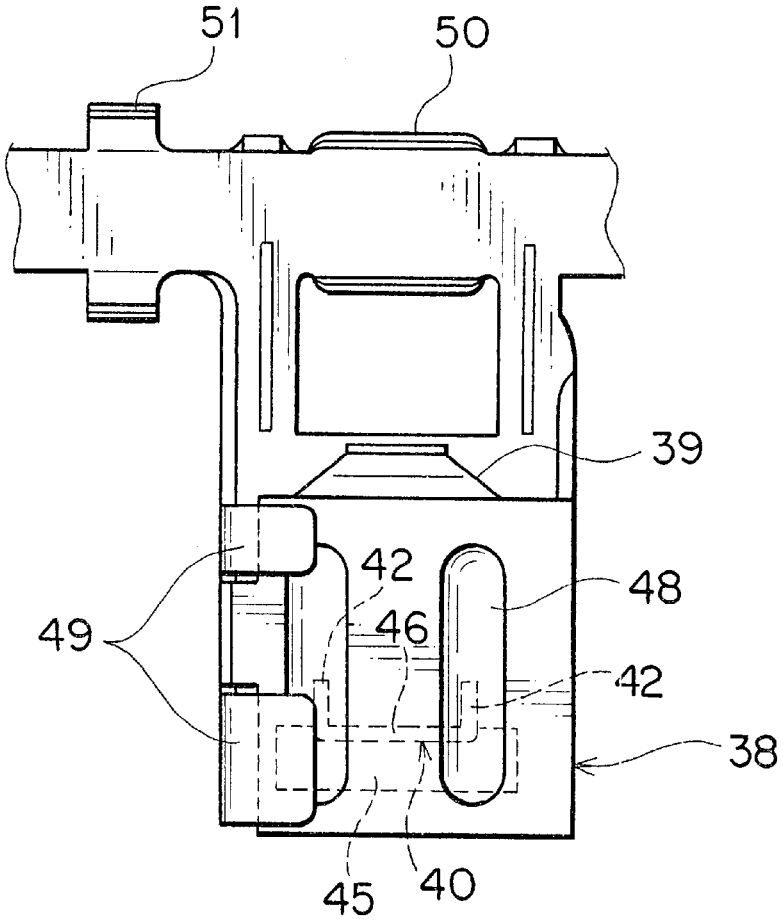
FIG. 12 is a plan view showing the third embodiment.
Figure 13:
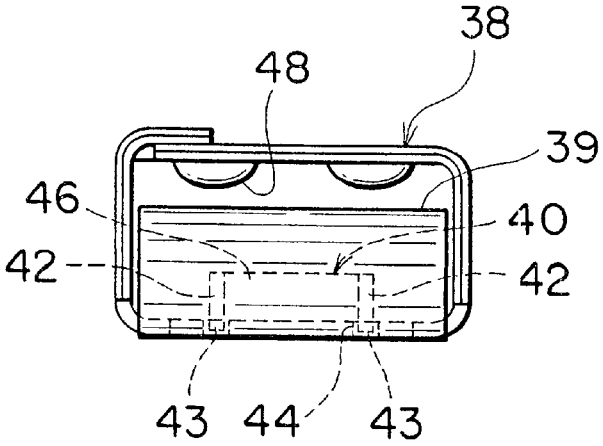
FIG. 13 is a front view showing the third embodiment.
Figure 14:
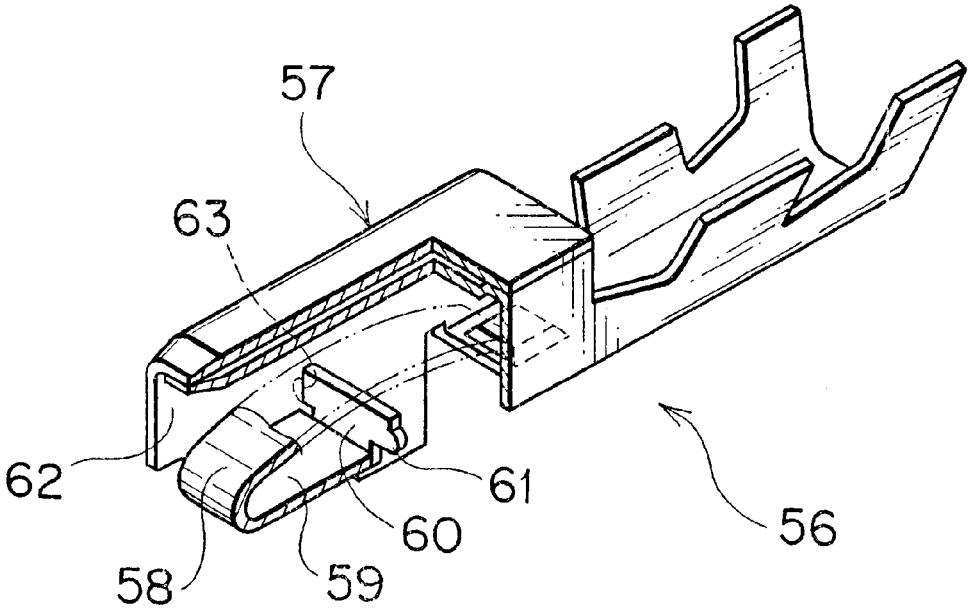
FIG. 14 PRIOR ART
FIG. 14 is a perspective view of a first prior art.
Figure 15:
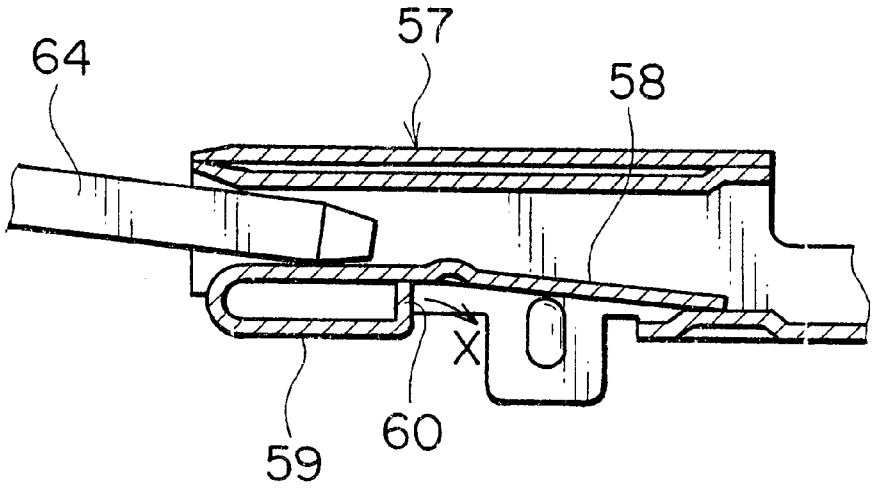
FIG. 15 PRIOR ART
FIG. 15 is a longitudinal sectional view of the first prior art.
Figure 16:
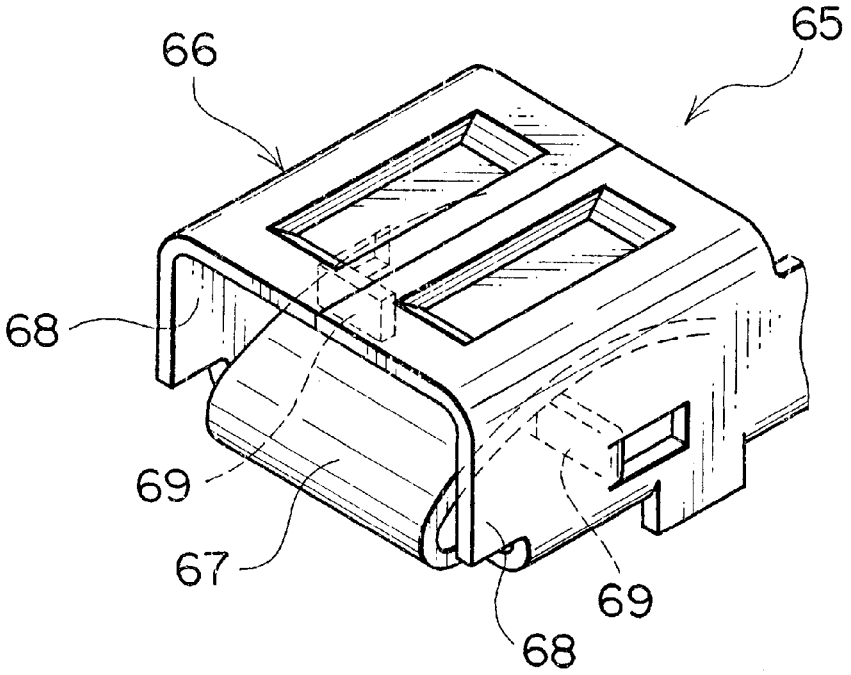
FIG. 16 PRIOR ART
FIG. 16 is a perspective view showing the second prior art.
Figure 17:
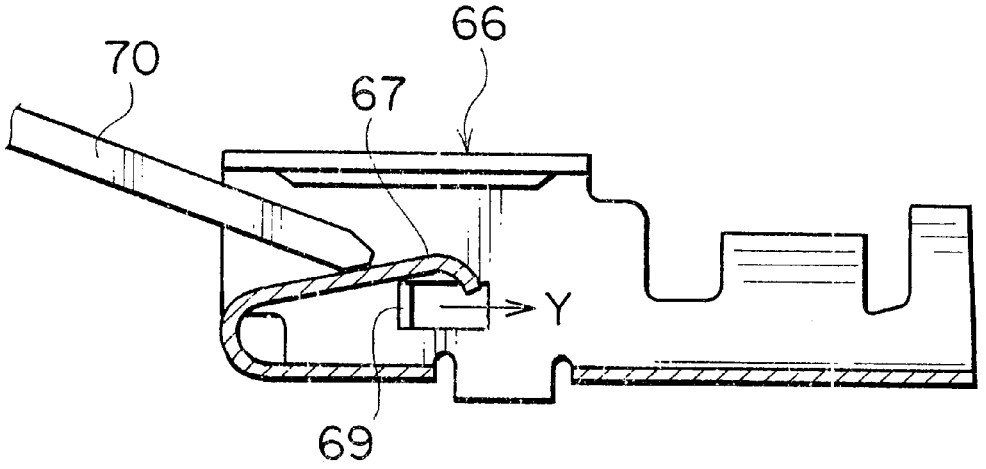
FIG. 17 PRIOR ART
FIG. 17 is a longitudinal sectional view showing the second prior art.
Figure 18:
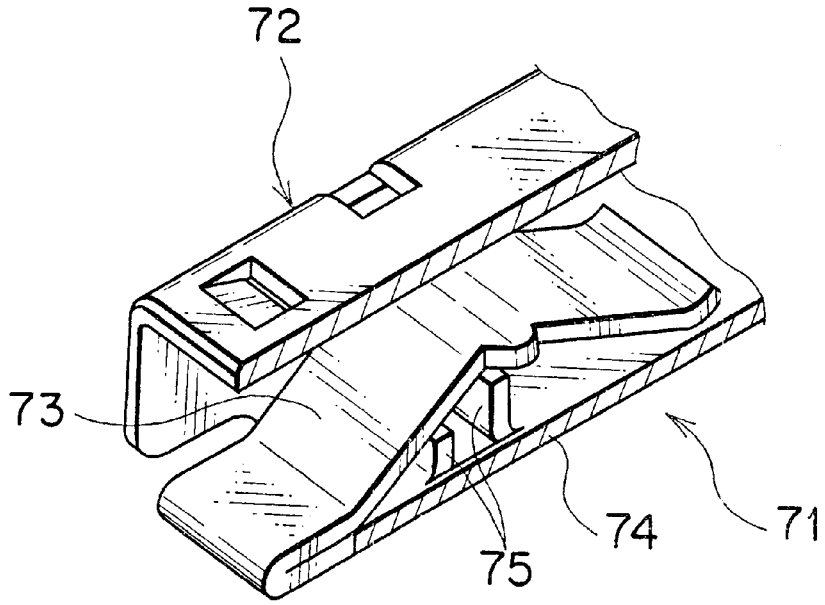
FIG. 18 PRIOR ART
FIG. 18 is a perspective view showing a third prior art.
Figure 19:
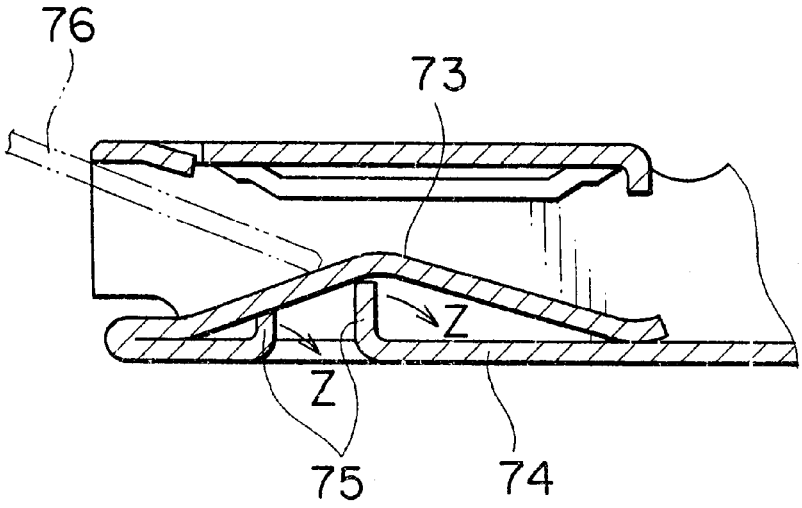
FIG. 19 PRIOR ART
FIG. 19 is a longitudinal sectional view of the third prior art.

As seen from FIGS. 12 and 13, the main wall 46 of the supporting plate 40 extends over a comparatively long distance widthise in the center portion of the electric contact portion 38, and the side wall 42 extends over a comparatively short distance in a longitudinal direction of the terminal along a protrusive contact strip 48. The stamped through-hole 45 is located in front of the supporting plate 40. In these figures, reference numeral 49 denotes a caulking piece, 50 an electric wire crimping piece and 51 an electric wire covered crimping piece.

In accordance with this embodiment, the main wall of the supporting plate is formed over a comparatively long distance widthwise, the side walls 42 are in contact with the bottom wall 41 to support the main wall in a direction perpendicular thereto, and the securing protrusion 43 of the side wall 42 is engaged in the engagement through-hole 44.

Thus, since the supporting plate 40 has high rigidity, even if excess pressing force is applied, it will not fall or come deformed. Further, even if the terminal 18 is miniaturized and the thickness of the supporting plate 40 is reduced, the supporting plate will not settled nor deformed against the pressing force so that the elastic contact piece 39 can be firmly supported by the supporting plate.

What is claimed is:

1. A settling preventing structure for a terminal including an electric contact portion and an elastic contact portion, comprising:

a supporting plate uprighted from a bottom wall of the electric contact portion and located on a warping side of the elastic contact portion, wherein said supporting plate is provided with both ends protruding horizontally in a height equal to that of itself, and both said ends are fixedly engaged in engagement grooves formed on inner side walls of said electric contact portion.

2. A settling preventing structure according to claim 1, wherein an entire width (L2) of said supporting plate is larger than a width (L1) of said bottom wall.

3. A settling preventing structure according to claim 2, wherein each of said engagement grooves is successive to a through-hole stamped from the bottom wall.

4. A settling preventing structure according to claim 1, wherein said engagement hole is successive to a through-hole stamped from the bottom wall.

5. A settling preventing structure for a terminal including an electric contact portion and an elastic contact portion, comprising:

a supporting piece cut out from an inner wall of the electric contact portion and located on a warping side of the elastic contact portion, wherein said supporting piece includes a stem wall bent from said inner wall and a tip wall bent integrally therefrom, and said stem wall and said tip wall are in contact with a bottom wall of said electric contact portion.

6. A settling preventing structure according to claim 5, wherein said tip wall is provided with a securing protrusion to be engaged in an engagement hole formed in the bottom wall.

7. A settling preventing structure for a terminal including an electric contact portion and an elastic contact portion, comprising:

a supporting plate uprighted from a bottom wall of the electric contact portion and located on a warping side of the elastic contact portion, wherein said supporting plate is provided with reinforcement walls bent on both sides thereof, and said reinforcement walls are in contact with the bottom wall of said electric contact portion.

8. A settling preventing structure according to claim 7, wherein said reinforcement walls are each provided with a securing protrusion to be engaged in an engagement hole formed in the bottom wall.

* * * * *